United States Patent [19]

Wesselink et al.

[11] 3,959,682

[45] May 25, 1976

[54] ELECTRIC LAMP

[75] Inventors: Gustaaf Adolf Wesselink, Emmasingel; Arie Koelewijn; Hendrik Roelofs, all of Eindhoven, Netherlands

[73] Assignee: U.S. Philips Corporation, New York, N.Y.

[22] Filed: Feb. 27, 1975

[21] Appl. No.: 553,543

[30] Foreign Application Priority Data

Mar. 11, 1974 Netherlands ..... 7403204

[52] U.S. Cl. ..... 313/217; 174/50.64; 313/227; 313/229; 313/332

[51] Int. Cl.[2] ..... H01J 5/50

[58] Field of Search ..... 313/332, 331, 217; 174/50.64

[56] References Cited

UNITED STATES PATENTS 3,582,704 6/1971 Fridrich ..... 313/332 X

*Primary Examiner*—R. V. Rolinec
*Assistant Examiner*—Darwin R. Hostetter
*Attorney, Agent, or Firm*—Frank R. Trifari

[57] ABSTRACT

Electric lamp having a hermetically sealed gas-filled hard-glass or vitreous-silica lamp envelope provided with a current lead-in which is sealed into a portion of the lamp envelope and comprises a foil mainly consisting of molybdenum and a current supply lead mainly consisting of tungsten which is secured to the foil by a welded joint and extends into the lamp envelope. The welded joint contains iron or an alloy of at least 50% by weight of iron and one or more of the elements scandium, titanium, vanadium, chromium, manganese, cobalt, nickel and copper as the welding agent.

6 Claims, 2 Drawing Figures

ELECTRIC LAMP

Figure 1:
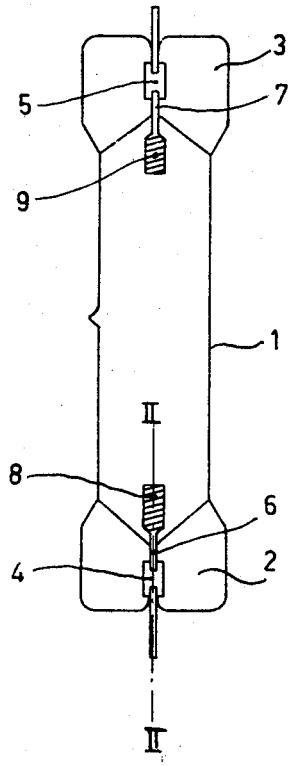

The invention relates to an electric lamp having a hermetically sealed gas-filled hard-glass or vitreous-silica lamp envelope provided with a current lead-in member which is sealed into part of the lamp envelope and comprises a foil consisting mainly of molybdenum and a current supply lead consisting mainly of tungsten which is secured to the foil by welding and extends into the lamp evenlope. The invention relates in particular to such lamps designed as gas discharge lamps.

Electric lamps of the abovementioned type frequently contain a more or less aggressive gas filling. Hence the materials to be used for the lamp components have to satisfy the requirement of being rsistant to the gas filling. The choice of hard glass or vitreous silica as a material for the lamp envelope is partly determined by this requirement. The tungsten current supply leads which extend into the lamp envelope also are resistant to the gas fillings most commonly used.

In order to obtain a vacuum-tight current lead-in through the wall of the lamp envelope molybdenum foils are used which are sealed in part of the lamp envelope. This seal may be in the form of a pinch, as is often used in tubular lamp envelopes. The current supply lead which extends into the lamp envelope is secured to the sealed-in molybdenum foil by welding.

It is known (see for example U.S. Pat. 2,876,377) to use platinum or nickel as a welding agent between the tungsten current supply lead and the molybdenum foil. Such a welding agent, more particularly the expensive platinum, improves the welded joint and increases the reliability of the current lead-in. This is a particular immportance for lamps which are operated with a comparatively large current strength. German patent application Ser. No. 1,956,484 describes halogen filament lamps in which in the weld between the molybdenum foil and the tungsten current supply lead aluminium is used as the welding agent.

A disadvantage of the aforementioned known welding agents is that they can be attacked by various gas filling components used in lamps, with consequent failure of the current lead-in and/or of the part of the wall of the lamp envelope surrounding the lead-in. The said attack may be due to chemical reactions, for example reactions with halogens in halogen filament lamps or with halides in halide-containing discharge lamps, to alloying, for example alloying with cadmium or zinc in discharge lamps, or to the formation of amalgam, for example in discharge lamps which contain mercury.

It is an object of the present invention to provide electric lamps having an improved welded joint between the molybdenum foil and the tungsten current supply lead.

An electric lamp of the abovementioned type according to the invention is characterized in that the welded joint contains iron or an alloy of at least 50% by weight of iron and one or more of the elements scandium, titanium, vanadium, chromium, manganese, cobalt, nickel and copper as a welding agent.

In a lamp according to the invention iron or an alloy mainly consisting of iron is used as the welding agent. It was found that by this means very good and reliable welded joints are obtained which do not fail at the temperatures which occur during the operation of the lamp. An advantage is that the welding agent used according to the invention is cheaper than the platinum commonly used itherto. It was found that in a lamp according to the invention the welding agent used is not attacked by lamp filling components such as mercury, cadmium, zinc, halogens and halides (with the exception of fluorine and fluorides). In addition to the aforementioned elements the welding agent may contain small amounts of, say, at most 3% by weight of other elements as incidental or deliberately introduced impurities. More particularly small amounts of carbon, nitrogen, sulphur, molybdenum, tantalum, niobium and aluminium may be present.

In a lamp according to the invention stainless steel is preferably used as a welding agent, for it provides very strong welded joints. An advantage of stainless steel is that it can readily be stored and worked. The term stainless steel used herein in the usual meaning of an iron-base alloy containing chromium and nickel and/or manganese. Very good results are obtained by using an alloy which contains about 18% by weight of chromium and about 8% by weight of nickel.

The invention is used to great advantage in lamps in which the current lead-in is sealed in a portion of the lamp envelope which is in the form of a pinch. Hence this construction is preferred.

A lamp according to the invention may, for example, be a halogen filament lamp. Preferably the invention is used in gas discharge lamps because such lamps frequently contain highly aggressive gas fillings. Such a gas discharge lamp is provided with at least two electrodes which are disposed witin the lamp envelope and are each secured to a current supply lead and between which in the operation of the lamp the discharge is maintained. The current supply leads are secured to a molybdenum foil by a welded joint according to the invention.

A preferred embodiment of a gas discharge lamp according to the invention is a lamp in which the gas filling contains at least one of the elements mercury, zinc and cadmium, for it was found that lamps containing these elements, in particular zinc and cadmium, are liable to rapid failure when the abovedescribed known welding agents are used. It may be stated that lamps having a long useful life and provided with cadmium and/or zinc have only become possible by the invention. This applies in particular to such lamps when intended for high powers, causing the welded joint to be heavily burdened.

Another preferred embodiment of a lamp according to the invention contains, in addition to mercury and cadmium and/or zinc, a calcium halide, a sodium halide and a halide of at least one of the elements lithium, thallium, indium, scandium, yttrium, lanthanum and the rare earth metals, for lamps containing such a gas filling have a very good colour rendition capability and a high luminous flux. In particular the presence of the aggressive cadmium and/or zinc in these lamps makes the use of a welded joint according to the invention between the current supply lead and the molybdenum foil necessary if the lamps are to have a long life.

Figure 2:
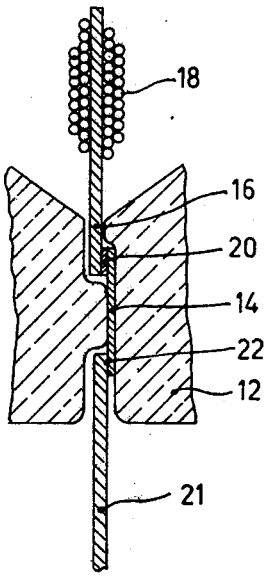

An embodiment of the invention will now be described, by way of example, with reference to the accompanying diagrammatic drawings, in which:

FIG. 1 is a schematic view of a high-pressure mercury-vapour discharge lamp containing a metal halide according to the invention, and FIG. 2 is a sectional view on an enlarged scale of the lamp of FIG. 1 taken on the line II—II.

Referring now to FIG. 1, reference numeral 1 denotes a vitreous silica lamp envelope of a lamp according to the invention. At either end of the envelope 1 a pinch 2 and 3 respectively is formed into which a current lead-in is sealed which comprises a molybdenum foil 4, 5 and a tungsten current suppy lead 6, 7 respectively. Within the lamp envelope the current supply leads 6 and 7 are connected to electrodes 8 and 9 respectively which each comprise a tungsten helix. As a rule, in practice the lamp is disposed in an outer jacket which is evacuated or filled with an inert gas (not shown in the drawing). The lamp envelope contains an amount of a noble gas as an ignition gas, mercury, cadmium and/or zinc and one/or more metal halides. The joint between the current supply lead 6 and the molybdenum foil 4 and that between the current supply lead 7 and the molybdenum foil 5 are established by spot welding thin foils of stainless steel or iron being interposed as welding agents between the tungsten lead 6, 7 and the molybdenum foil 4, 5 respectively.

FIG. 2 shows schematically on an enlarged scale a sectional view of part of the lamp of FIG. 1 taken on the line II—II. Reference numeral 12 denotes the vitreous silica of the pinch. The vitreous silica engages the molybdenum foil 14 in a vacuum-tight manner. An external current supply lead 21 made of molybdenum is secured to the molybdenum foil 14 at 22 by spot welding. The tungsten current supply lead 16 which extends into the lamp envelope is secured to the molybdenum foil 14 by means of an interposed welding foil 20 of iron or stainless steel.

A lamp as shown in FIG. 1 (electrode spacing 40 mm; outer diameter 16 mm) was filled with a mixture of neon and 1% argon to a pressure of 40 torr and further with 0.12 mmole of NaI
0.08 mmole of $CaI_2$
0.04 mmole of $NdI_3$
1.0 mg of Tl
10 mg of Cd
24 mg of Hg The lamp, which has welded joints between the current supply lead and the molybdenum foil which were made with the use of stainless steel (18% by weight of Cr and 8% by weight of Ni) as the welding agent, produces a luminous flux of 76 lm/W at a power consumption of 400 W. The colour temperature of the emitted radiation is 3,950 K and the mean color rendition index Ra is 92. The lamp has an average life of more than 3,000 hours.

Lamps identical with the above described lamp but in which iron is used as the welding agent were found to have substantially the same measurements and the same average life.

For comparison it should be mentioned that lamps in which platinum is used as the welding agent for making the joint between the current supply lead and the molybdenum foil but otherwise identical with the abovedescribed lamp have an average life of only about 100 hours. These lamps fail owing to cracking of the quartz pinch.

We claim:

1. Electric lamp having a hermetically sealed gas-filled hard-glass or vitreous-silica lamp envelope provided with a current lead-in which is sealed into a portion of the lamp envelope and comprises a foil mainly consisting of molybdenum and a current supply lead mainly consisting of tungsten which is secured to the foil by a welded joint and extends into the lamp envelope, characterized in that the welded joint contains iron or an alloy of at least 50% by weight of iron and one or more of the elements scandium, titanium, vanadium chromium, manganese, cobalt, nickel and copper as the welding agent.

2. Electric lamp as claimed in claim 1, characterized in that the welding agent is stainless steel.

3. Electric lamp as claimed in claim 2, characterized in that the current lead-in is sealed in a portion of the lamp envelope in the form of a pinch.

4. Gas discharge lamp as claimed in claim 3 provided with at least two electrodes which are disposed within the lamp envelope and each are secured to a current supply lead and between which the discharge is maintained in the operation of the lamp.

5. Gas discharge lamp as claimed in claim 4 in which the gas-filling contains at least one of the elements mercury, zinc and cadmium.

6. High pressure mercury-vapour discharge lamp as claimed in claim 5, in which the gas-filling contains, in addition to mercury and cadmium and/or zinc, a calcium halide and a sodium halide and a halide of at least one of the elements lithium, thallium, indium, scandium, yttrium, lanthanum and the rare earth metals.

* * * * *